US005260918A

United States Patent [19]

Neustein et al.

[11] Patent Number: 5,260,918

[45] Date of Patent: Nov. 9, 1993

[54] WATER SAVING APPARATUS AND METHOD OF USING SAME

[76] Inventors: Paul Neustein, 13368 Calle Colina, Poway, Calif. 92064; Yuval Shenkal, 13181 Sundance Ave., San Diego, Calif. 92129

[21] Appl. No.: 844,503

[22] Filed: Mar. 2, 1992

[51] Int. Cl.[5] ..... G04F 1/06

[52] U.S. Cl. ..... 368/95; 368/93

[58] Field of Search ..... 4/597, 605, 661; 368/91, 93, 94, 95, 316, 317

[56] References Cited

U.S. PATENT DOCUMENTS 3,874,161 4/1975 Asla ..... 368/91
4,944,049 7/1990 Leonard ..... 4/597

FOREIGN PATENT DOCUMENTS 1030611 6/1953 France ..... 368/95
0142604 12/1930 Switzerland ..... 368/93
2242040 9/1991 United Kingdom ..... 368/91

*Primary Examiner*—William A. Cuchlinski, Jr.
*Assistant Examiner*—W. Morris Worth
*Attorney, Agent, or Firm*—Bernard L. Kleinke; Jerry R. Potts

[57] ABSTRACT

A new and improved water saving apparatus having a timing device which may be visually observed by a person for the purpose of timing the length of a shower. The water saving apparatus is adapted to be mounted to the wall of a shower stall and includes finger gripping projection for allowing the timing device to be restarted after a predetermined period of time such as a three minute period of time.

9 Claims, 2 Drawing Sheets

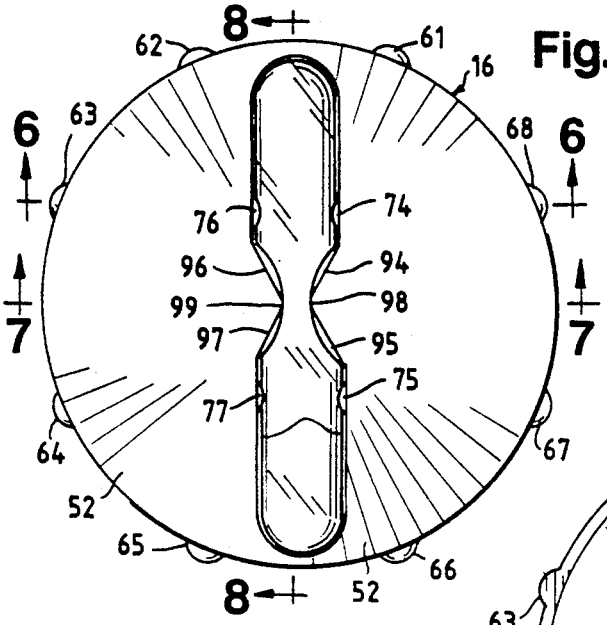
Fig. 3
Fig. 9
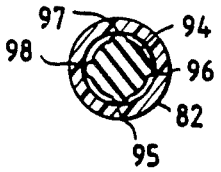
Fig. 4
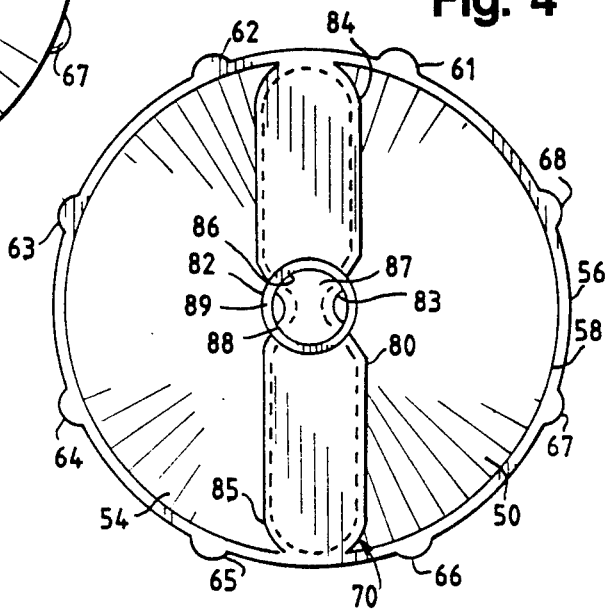
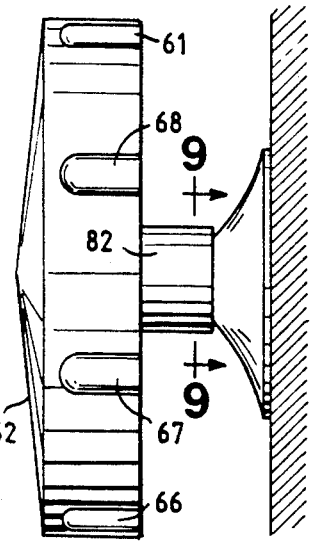
Fig. 5
Fig. 8
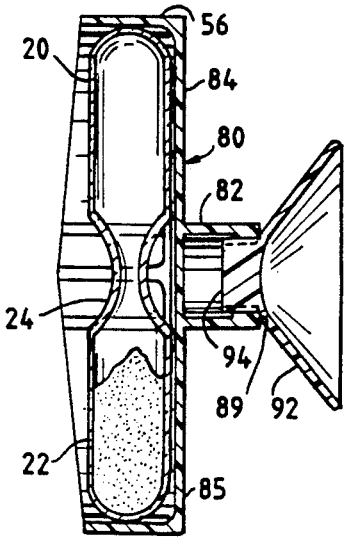
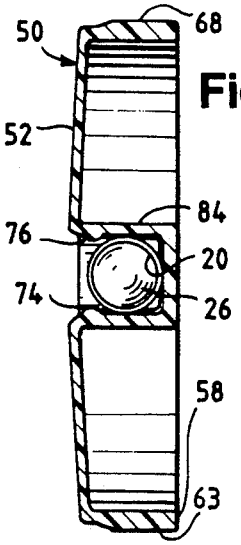
Fig. 6
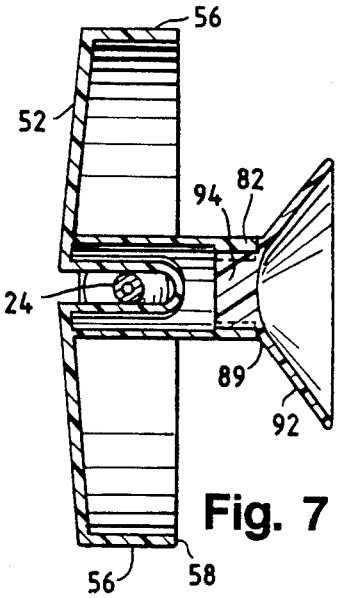
Fig. 7

WATER SAVING APPARATUS AND METHOD OF USING SAME

TECHNICAL FIELD

This invention relates in general to a water saving apparatus and method of using same, and more particularly it relates to a shower water saving apparatus and method of using it in a shower.

BACKGROUND ART

Water conservation has become one of the most significant problems of the modern era. Frequent shortages of rainfall across many parts of the United States in the past, have occasioned increased awareness of the need for water conservation.

The problem of improper and overuse of the fresh water supply of the United States has merely been compounded by the significant increase in population of the United States in the past two decades. Considering this increase in population, those areas of the country with some of the most acute water shortage problems have grown the fastest in population.

It is particularly in those areas where population has increased the most, where the general population has been most sensitive to the need for new and improved devices for saving water. But unfortunately, some of the most common everyday activities for most people require the most water. For example, toilets and showers consume more water than any other devices in the home. Although the public is aware of the need for water conservation. public support for environmental programs has grown steadily through the years.

In the past, Various means have been employed to reduce the consumption of water in toilets and showers. In particular, in the case of toilets, various valves and flotation devices have been installed in order to raise the water level. The rising of the water level permits toilets to consume less water each time they are flushed.

In a similar manner, flow restrictors have been developed for insertion into shower heads, which restrict the amount of water a shower utilizes. While such techniques and devices help save water, such shower flow restrictors only save a small quantity of water as the discharge from the shower head is irretrievably lost as it gushes down the drain. Thus, while such restrictors enhance conservation, they are not entirely adequate to meet the requirements in some areas of the country where clearly significantly less water consumption is required.

Therefore, it would be highly desirable to have a new and improved water savings apparatus and method of using the same in the shower, which would be relatively inexpensive and easy to install and which would allow the saving of large quantities of water utilized for shower purposes.

DISCLOSURE OF INVENTION

Therefore, the principle object of the principle object of the present invention is to provide a new and improved water saving apparatus and method of using the same in a conventional shower enclosure.

Another object of the present invention is to provide such a new and improved water saving apparatus and method of using the same that is relatively easy to install and inexpensive to manufacture.

Briefly, the above and further objects of the present invention are realized by providing a new and improved water saving apparatus having a timing device, in the form of an hourglass timer, which is adapted for use in a high humidity hot environment and which may be observed visually by a person for the purpose of timing the length of a shower. The water saving apparatus includes a rotatable housing adapted to be mounted to the wall of a shower stall and includes finger gripping projection for allowing the timing device to be rotated for restarted purposes after a predetermined period of time, such as a three minute period of time.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 3 is a front face elevational view of a holding member of FIG. 2;

FIG. 4 is a rear face elevational view of the holding member of FIG. 3;

FIG. 5 is a side elevational view of the water saving apparatus of FIG. 1 shown illustratively mounted to the wall of a shower stall.

FIG. 6 is a cross sectional view of the water saving apparatus of FIG. 3 taken substantially along lines 6—6;

FIG. 7 is a cross sectional view of the water saving apparatus of FIG. 3 taken substantially along lines 7—7;

FIG. 8 is a cross sectional view of the water saving apparatus of FIG. 3 taken substantially along line 8—8; and FIG. 9 is a cross sectional view of the water saving apparatus of FIG. 5 taken substantially along lines 9—9.

BEST MODE FOR CARRYING OUT THE INVENTION

Figure 1:
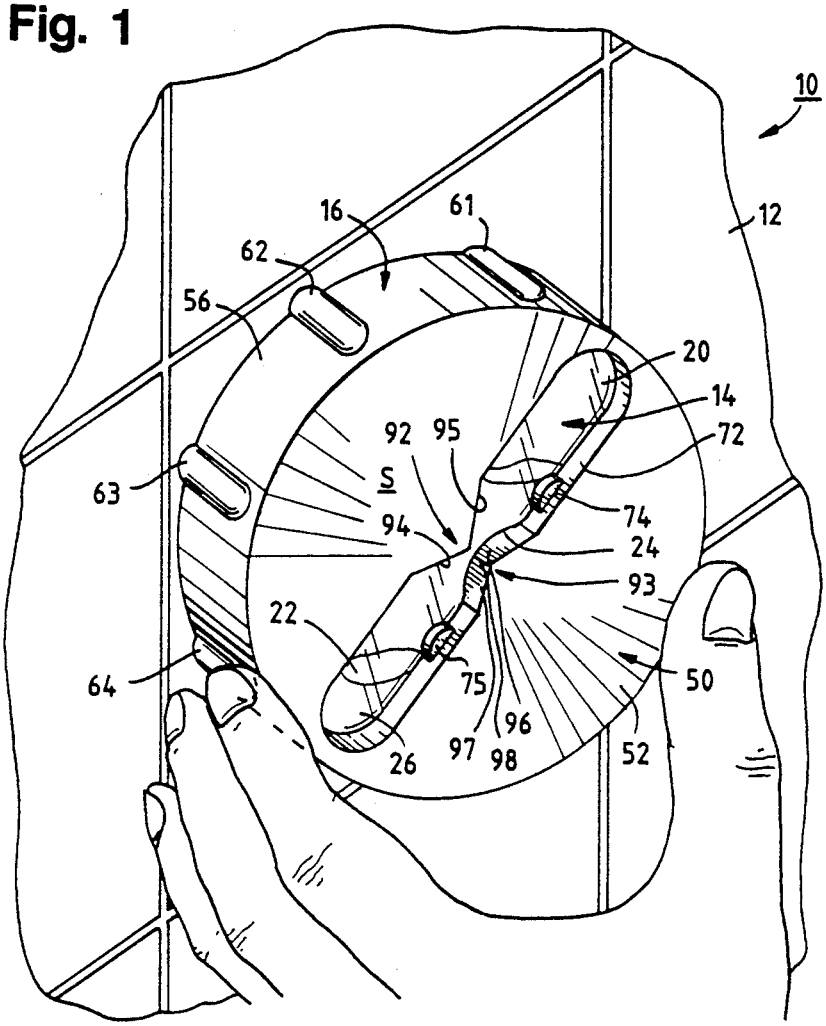
FIG. 1 is a pictorial view of the water saving apparatus shown illustratively installed on the wall of a shower stall.

Referring now to the drawings and more particularly to FIG. 1 thereof, there is shown a water saving apparatus 10 which is constructed in accordance with the present invention and which is shown mounted to a wall 12 of a conventional shower stall.

Figure 2:
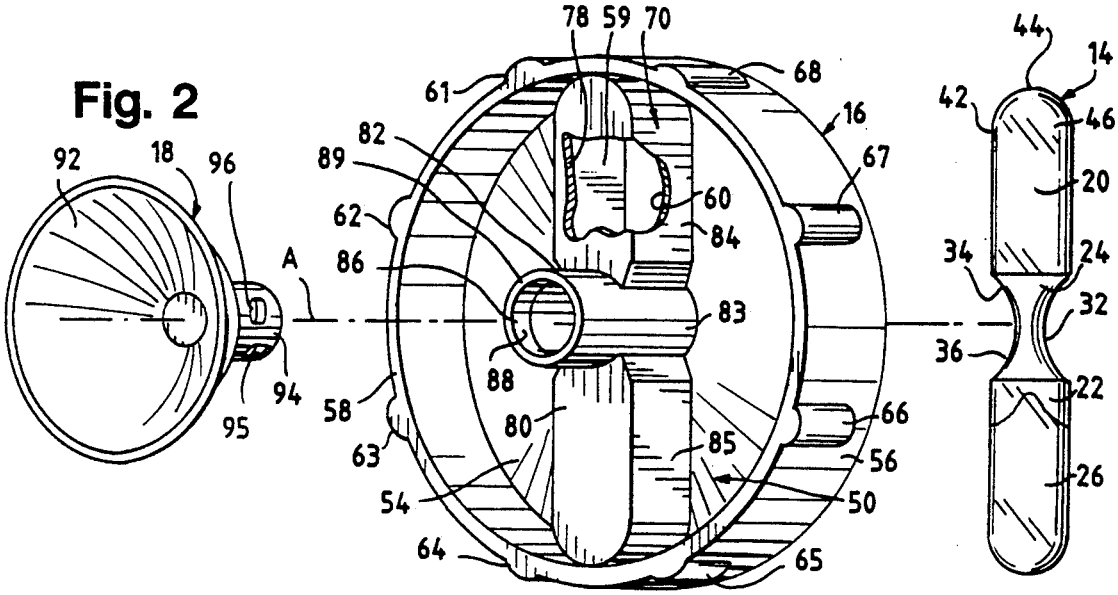
FIG. 2 is an exploded view of the water saving apparatus of FIG. 1.

The water saving apparatus 10 generally comprises a timing device 14 in the form of a hourglass timer that provides a visual indication of the elapsed time of a given period of discharging water from a shower head (not shown). A rotatable housing 16 supports the timing device 14 in a stationary position and is adapted to be mounted to the wall 12 by a mounting device 18 (FIG. 2). The housing 16 and mounting device 18 are so constructed and arranged to cooperate together to enable a user to rotate the housing 16 axially about a centrally disposed axis shown generally at A (FIG. 2) for the purpose of resetting the timing device 14. In this regard, the timing device 14 includes a pair of spaced apart transparent elongated bulbs or enclosures 20 and 22 respectively that are interconnected by a transparent intermediate tube 24. A granular material 26, such as grains of sand, salt or other similar material, is enclosed within the timing device 14 and is metered so that it takes a predetermined period of time for the whole of the granular material 26 to fall under the force of gravity through the tube 24 from one enclosure to the other, such as from bulb 20 to bulb 22.

In operation, a user (not shown) mounts the water saving apparatus 10 to the wall 12 of the shower stall at a convenient height and then causes the shower head (not shown) to commence discharging a continuous stream of water. For the purpose of conserving the total of amount of water discharged during the shower period, the user rotates the housing 16 to cause all of the granular material 26 disposed in one of the enclosures, such as the bulb 20 to be disposed substantially entirely above the opposite bulb 22 in order to permit the granular material 26 in the upper bulb to fall under the force of gravity through the tube 24 into the lower bulb. The user then commences taking his or her shower as the granular material 26 is transferred entirely from one bulb to the other bulb. At the end of the predetermined period time after the granular material 26 has traversed from one bulb to the other, the user stops the discharge of water. Thus, the total amount of water discharged during the shower period is substantially that quantity of water that was discharged during the above-mentioned predetermined period of time.

Considering now the timing device 14 in greater detail with reference to FIGS. 1-3 and 6-8, the timing device 14 is composed of a transparent material, such as a glass or plastic material, that is not easily broken and that is not subject to corrosion through exposure to moisture. The timing device 14 is configured in an "hour-glass" shape for controlling the flow of the granular material 26 from one enclosure to the other, such as from bulb 20 to bulb 22.

Considering now the tube 24 in greater detail with reference to FIG. 3, 7 and 8, the tube 24 defines a passageway from bulb 20 to bulb 22 and includes a centrally disposed annularly-shaped narrow or constricted portion 32 which is disposed between and integrally connected to a pair of oppositely disposed equally dimensioned end portions 34 and 36. The end portions 34 and 36 are flared outwardly and integrally connected to the bulbs 20 and 22 respectively. The diameter of the narrow portion 32 is substantially smaller than the diameter of either end portion, such as end portion 34 thus, limiting the flow of the granular material 26 therethrough. In this regard, the diameter of the narrow portion 32 is sufficiently small that it prevents the whole of the granular material 26 disposed in one enclosure from traversing under the force of gravity to the other enclosure in less than a given predetermined period of time, such as a three minute or five minute period of time.

Considering now the bulb 20 and the enclosure 22 in greater detail with reference to FIGS. 3, 6 and 8, the bulb 20 and bulb 22 are substantially identical to one another so only bulb 20 will be described hereinafter. As best seen in FIG. 3, the bulb 20 is generally bulb shaped having a cylindrically shaped tube portion 42 that is integrally connected at one of its ends to the end portion 34 and integrally connected at its opposite end to a cup-shaped end portion 44. The end portion 44 includes an annularly-shaped neck portion 46 that has a diameter that is dimensioned substantially the same as the diameter of the tube portion 42. The hollow interior of the bulb 20 is dimensioned to receive therewithin a metered portion of the granular material 26.

Considering now the housing 16 in greater detail with reference to FIG. 1-8 the housing 16 generally comprises a cup-shaped base plate 50 having an outwardly projecting front face portion 52 and a rear face portion 54. The base plate 50 terminates in an integrally connected upstanding flange member 56 which extends about its entire outer periphery. The flange member 56 terminates in a rim 58 and includes a plurality of equally shaped apart integrally connected rib members, such as ribs 61-68, that protrude outwardly from the outer surface of the flange 56. Each rib member, such as the rib member 61 is an elongated, smoothly contoured protuberance extending from the rim 58 toward the peripheral edge of the base plate 50. In this regard, the ribs 61-68 provide gripping areas for the fingers of a user (not shown) for helping to facilitate the rotation of the housing 16 about its centrally disposed longitudinal axis shown generally at A (FIG. 2).

The housing 16 also includes an open compartment 70 (FIG. 2) that extends perpendicularly upwardly from the rear face portion 54. The compartment 70 defines an open well or recess 72 (FIG. 1) in the front face portion 52. In this regard, the well 72 is complementarily shaped to the timing device 14 in order to receive the device 14 therewithin. As best seen in FIG. 2, the well 72 is defined by a base or floor portion 78 that extends across substantially the entire diameter of the base plate 50, a pair of oppositely disposed triangularly shaped body portions 92 and 93, and a pair of elongated bulb receiving portions 84 and 85.

As best seen in FIGS. 1, 3 and 8, the body portions 92 and 93 each include a pair of sloping surface 94, 95 and 96, 97 respectively which terminate in a pair of flat apex portion 98 and 99 respectively. The apex portions 98 and 99 are spaced apart from one another a sufficient distance to allow their flat surfaces to snugly engage the outer wall surfaces of the narrow portion 32 of the tube 24. The bulb receiving portions 84 and 85 each include a pair of spaced apart parallel inner walls, such as walls 59 and 60. The distance between the walls such as walls 59 and 60 is slightly wider than the transverse dimension of bulb 20 to permit the bulb 20 to be received thereinbetween. The depth of the well 72 is dimensioned substantially greater than either the diameter of the bulbs 20 or bulb 24 in order to permit the entire timing device 14 to be received therewithin. In this regard, no part of the timing device 14 projecting above the surface (S) of the front face portion 52.

For the purpose of retaining the timing device 14 within the recess 72, a set of spaced apart detents or projection 74-77 are disposed therein. The detents such as detents 74 and 76 are disposed closer to the surface S than the floor 78 and extend inwardly from the walls of the recess 72, such as the walls 59 and 60. In this regard, they extend inwardly a sufficient distance to permit the timing device 14 to be urged under force into engagement with the floor 78 of the recess 72. The detents are also spaced apart from the floor 78 a sufficient distance so that a significant portion of the timing device 14 passes beyond the detents 74-77 to secure the timing device 14 within the recess 72.

Considering now the compartment 70 in still greater detail with reference to FIGS. 1-4, the compartment 70 includes an elongated hollow lower body portion 80 which is integrally connected to a generally cylindrically-shaped upwardly projecting centrally disposed hollow boss member or hub 82. The lower body portion 80 includes the bulb receiving portions 84 and 85 and extends across the entire diameter of the base plate 50. The interior of the lower body portion 80 therefore defines the well 72. The lower body portion 80 also includes a narrow central portion 83 that is integrally connected to the bulb receiving portions 84 and 85. The bulb receiving portions 84 and 85 are disposed on opposite sides of the central portion 83 and are integrally connected to the flange member 56 at their outer peripheral surfaces respectively. The height of the bulb receiving portions 84 and 85 are substantially the same and are dimensioned to corresponds to the height of the flange member 56 to form a smooth contiguous surface between the top surface of the bulb receiving portion 84 and 85 and the surface of the rim 58.

As best seen in FIGS. 2 and 5 the hub 82 include an inner wall portion 86 that extend perpendicularly upwardly from a centrally disposed top surface portion 87 of the lower portion 80 terminating in a rim 89 defining an annularly shaped opening 88. The opening 88 is dimensioned for receiving the mounting member 18 as will be described hereinafter in greater detail.

Considering now the mounting member 18 in greater detail with reference to FIGS. 2, 5, 7 and 8, the mounting member 18 has a unitary construction and is composed of a pliable resilient deformable material such as a rubber material. The mounting member 18 includes a cup-shaped base portion 92 and a cylindrically shaped neck portion 94 which is adapted to be snugly received within the opening 88. The base portion 92 is deformable when depressed towards a stationary surface, such as the wall 12, and is adapted to engage the wall 12 releasably with a suction-like pressure when a user forcibly compresses and deforms the base portion 92 against the wall 12. In this regard, a suction-like force is created when the air trapped within the base portion 92 escapes and the base portion 92 attempts resiliently to assume an undeformed shape. This suction-like force permits the mounting member 18 to be retained releasable against the wall 12.

As best seen in FIG. 9, the neck portion 94 includes a set of spaced apart deformable projections 95–98 which extend circumferentially around an upper portion of the neck 94. In this regard, when the neck portion 94 is received within the opening 88 the projections 95–98 engages the inner wall of the upper body portion 82 to define a series of pressure point for securing the mounting member 18 within the upper body portion 82. As the projections are deformable, the housing 16 may be rotated about the neck portion 94. Also because the projections 95–98 extend outwardly from the surface of the neck 94 there is no need for tight tolerance specification between the inner diameter of the body portion 82 and the outer surface diameter of the neck portion 94. As best seen in FIGS. 7 and 8, the neck portion 94 is received within the upper body portion 82 a sufficient distance to support the housing 18 therefrom and although there is a snug fit between the neck 94 and the wall 86 the projections 95–98 enables the housing 18 to be rotated about the neck portion 94.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A device for helping to conserve water consumption, comprising:

timing means for providing a visual indication of the elapse of a predetermined period of time to permit conservation of water;

said timing means including a transparent elongated enclosure with a metered portion of granular material disposed therein;

base means having a centrally disposed elongated open compartment for receiving said timing means therein;

said compartment having a hollow interior complementarily shaped to said timing means and an outer surface area with a centrally disposed hollow hub for facilitating the mounting of said base means to a stationary surface;

mounting means for securing removably said base means to said stationary surface;

means for attaching rotatably said base means to said mounting means to permit said timing means to be rotated to an inverted substantially vertical position to initiate said predetermined period of time; and said base means includes a plurality of detent means for securing removably said timing means within the hollow interior of said compartment.

2. A device according to claim 1, wherein said enclosure includes a centrally disposed tubular portion having a pair of spaced apart end portions integrally connected respectively to a pair of bulb portions extending in diametrically opposite directions from one another.

3. A device according to claim 2, wherein said tubular portion includes a constricted central portion for limiting the flow of said granular material therethrough under the force of gravity from one bulb portion to the other bulb portion.

4. A device according to claim 3, wherein said mounting means is suction-cup means for securing removably the device to a stationary surface.

5. A device according to claim 4, wherein said suction-cup means is composed of a pliable, resilient, deformable material.

6. A device according to claim 5, wherein said suction cup means include a cup shaped base portion having a hollow interior and an outer surface area with a centrally disposed cylindrically shaped neck portion extending therefrom.

7. A device according to claim 6, wherein, said hollow hub includes an inner wall; and wherein said cylindrically shaped neck portion has a plurality of spaced apart projections that extend perpendicularly outwardly form the outer surface of said neck portion a sufficient distance for engaging the inner wall of said hollow hub for enabling said cylindrically shaped neck portion to be received within said hollow hub in a snug tight fit.

8. A device according to claim 7, wherein said base means is generally circular in shape and further includes an integrally connected flange extending about the entire outer periphery of said base means to help facilitate the gripping of said base means.

9. A device according to claim 8, wherein said flange includes a plurality of equally shaped apart smoothly contoured protuberance extending upwardly from its outer surface and circumferentially therearound to further help facilitate the gripping of said base means for rotational purposes.

* * * * *